United States Patent [19]

Ishammar

[11] 4,010,341

[45] Mar. 1, 1977

[54] HOT AIR OVEN

[75] Inventor: Nils Gosta Sigvard Ishammar, Malmo, Sweden

[73] Assignee: IFO Kampri AB, Sweden

[22] Filed: Nov. 12, 1973

[21] Appl. No.: 415,280

[30] Foreign Application Priority Data

Nov. 13, 1972 Sweden ..... 14692/72

[52] U.S. Cl. ..... 219/400; 34/233; 126/21 A; 219/368; 432/206

[51] Int. Cl.² ..... H05B 1/00; F24C 7/00; F24C 15/32

[58] Field of Search ... 219/400, 385, 386, 391–393, 219/369, 370, 368; 126/21 R, 21 A, 273, 273 A; 432/206; 34/201, 202, 218, 219, 224, 225, 226, 231–233, 243 R

[56] References Cited

UNITED STATES PATENTS

| | | | |
|---|---|---|---|
| 1,721,840 | 7/1929 | Smith | 219/400 X |
| 1,827,194 | 10/1931 | Grothe | 219/400 X |
| 2,523,796 | 9/1950 | Wecles | 219/400 |
| 2,549,106 | 4/1951 | Mamacher | 34/233 X |
| 2,641,679 | 6/1953 | Brodbeck | 219/368 X |
| 2,966,573 | 12/1960 | Hansen | 126/21 A |
| 3,261,650 | 7/1966 | Stromgvist | 219/400 |
| 3,368,062 | 2/1968 | Gramenius et al. | 219/400 |
| 3,586,516 | 4/1969 | Terc | 219/400 X |
| 3,759,241 | 9/1973 | Berkhoundt | 126/21 A |

FOREIGN PATENTS OR APPLICATIONS

| | | | |
|---|---|---|---|
| 305,061 | 4/1955 | Switzerland | 219/400 |
| 348,369 | 5/1931 | United Kingdom | 219/400 |
| 664,461 | 1/1952 | United Kingdom | 219/400 |

*Primary Examiner*—A. Bartis
*Attorney, Agent, or Firm*—Ladas, Parry, Von Gehr, Goldsmith & Deschamps

[57] ABSTRACT

An oven for treating food including a well of sheet metal material that is open at the top, a removable insert open at the top end located in the well, the side walls and bottom of the insert being spaced from the side walls and bottom of the well to define air circulating passages therebetween with the top of the circulating passages being open. The insert also includes a plurality of gill openings formed in the side walls of the insert, the gill openings having the open portion thereof facing upwards on the outer side of the insert to divert air from the air passages into the interior of the insert. The insert further includes openings at the bottom thereof for communicating the air passages with the interior of the insert. The oven further includes a removably fitted lid which forms the top thereof, and an air circulating fan depending from the lower side of the lid for drawing air upwardly out of the insert. The fan serves to propel air laterally to the open top of the air passages for circulation downwardly through the air passages for entry into the interior of the insert for circulation over an object that is to be heated. An electrical heater is mounted on the lower side of the lid for heating air circulated by the fan.

2 Claims, 5 Drawing Figures

HOT AIR OVEN

Small restaurants often cannot afford to have a set of different apparatuses for various processes of preparation, for instance a hot air oven, a grill, an electronic oven, a steam boiler etc. The result will be that a simple warming device is resorted to, comprising a well open at the top and countersunk in a counter top or similar support, in which food, optionally packed in portions, can be kept warm during the serving. Thus, such facilities are lacking that are indispensable for an optional exploitation of the various forms of distribution of ready-made or partly ready-made food that are now available, together with raw material for food stuff preparing.

An object of the invention is to achieve an improvement in said respect, by making different processes of preparation available by simple means, in the first place allowing to use a simple warming device referred to above for thawing deep-frozen portions of food by warming from inside, at the same time allowing to supplement the apparatus with additional means for various methods of warming and preparation.

According to the invention this object is achieved by an oven with a fan, a heater and circulation passages, wherein the oven comprises a well in a counter or similar support, open at the top, with a removable insert therein defining together with said well the circulation passages, and wherein the fan and the heater are positioned on the lower side of a lid removably fitted over the well to form a top closure thereof.

Figure 1:
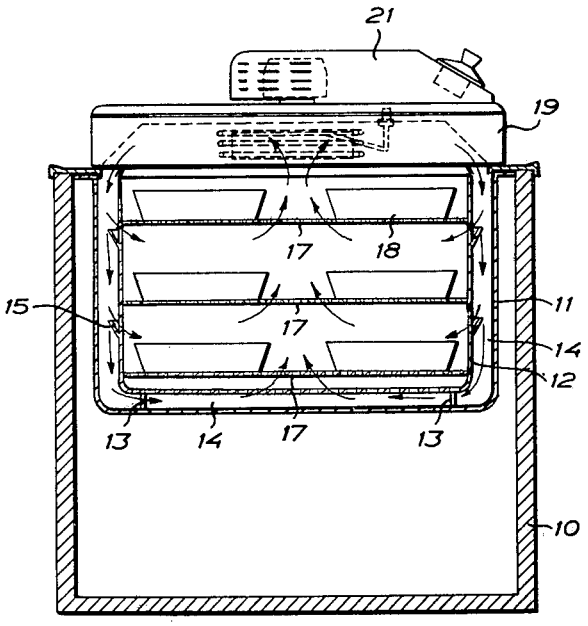
FIG. 1 is a diagrammatical vertical sectional view of the oven.
Figure 2:
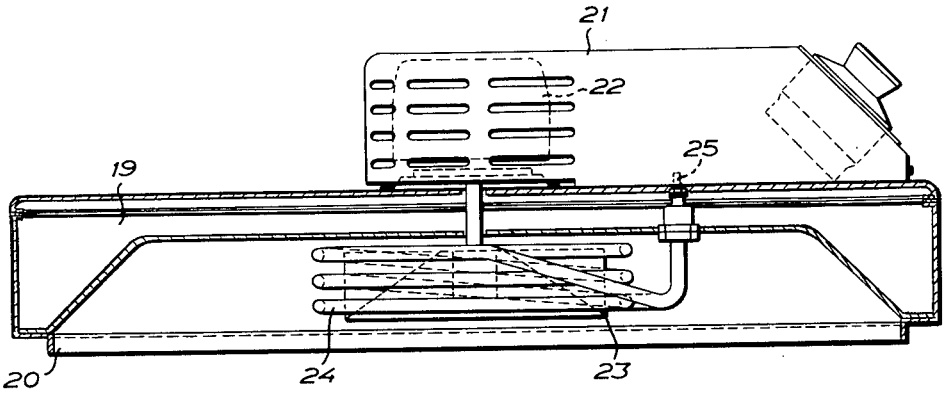
FIG. 2 is a vertical sectional view of the lid constituting an essential portion of the oven, which is associated with a well, likewise constituting an element of the oven.
Figure 3:
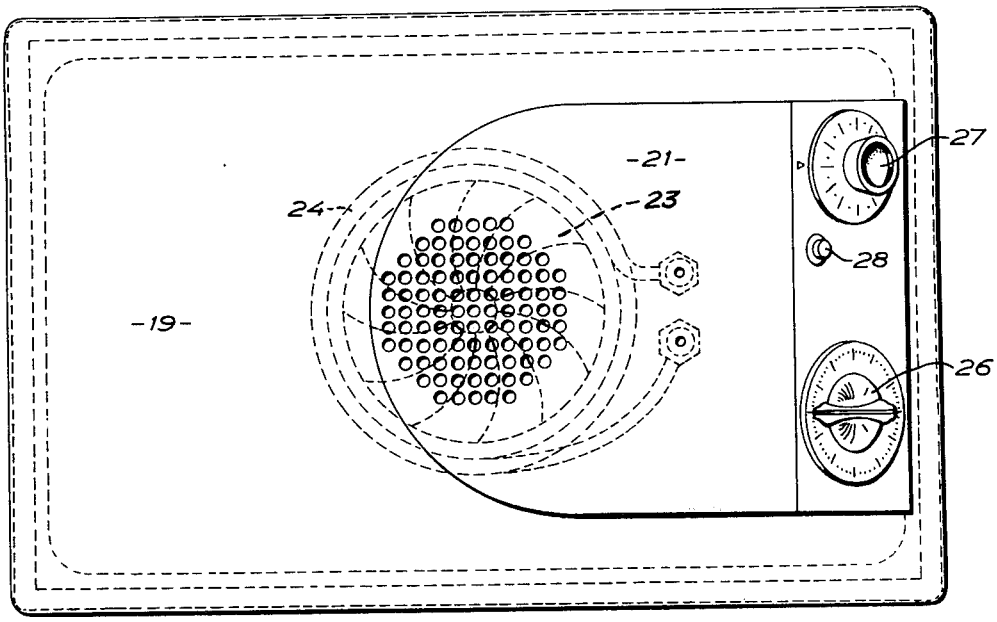
FIG. 3 is a plan view of the lid of FIG. 2.
Figure 4:
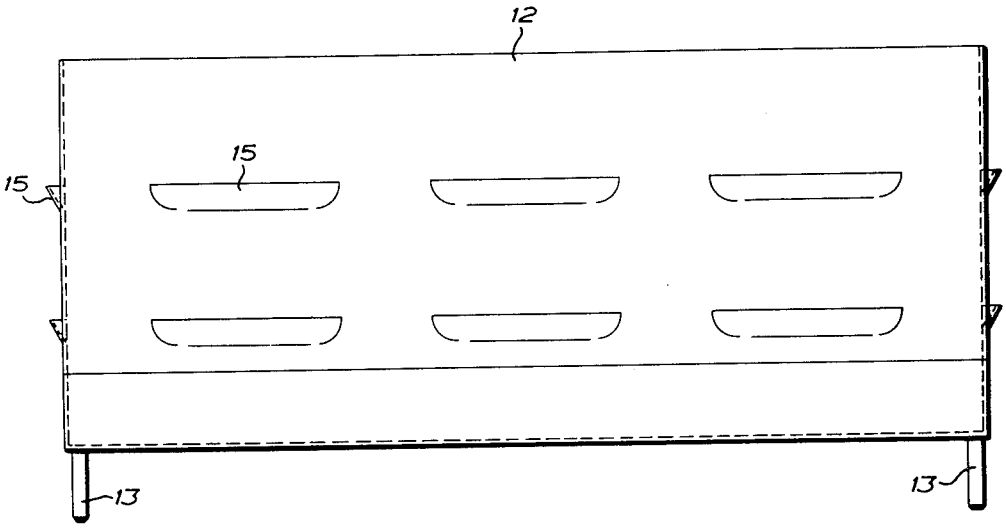
FIG. 4 is a side elevational view of an insert to be disposed in the well.
Figure 5:
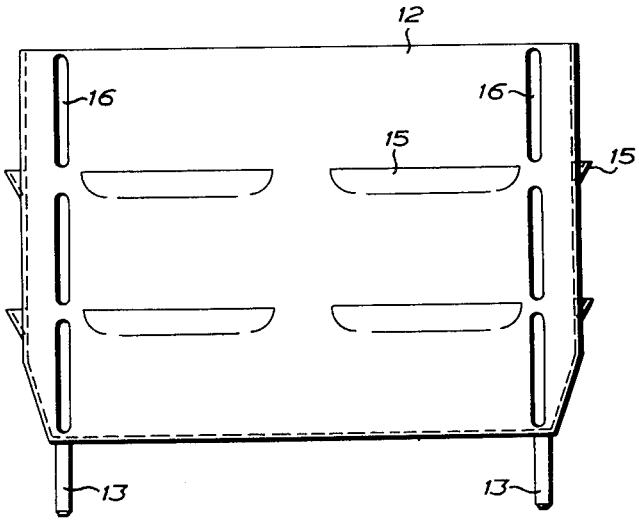
FIG. 5 is an end view of this insert.

In a counter 10 a well 11 of high polished stainless plate, open at the top, is countersunk in the usual way. This well may be provided with a heating jacket for keeping the food warm therein or may comprise a conventional well without any temperature control means, of the kind used for storing cold food. In the well there is provided an insert 12 also made of high polished stainless plate and provided with legs 13 to stand on the bottom of the well therewith, said insert being of a somewhat smaller size than the well in order to provide a gap 14 between the side and bottom walls of the insert and the well, respectively, as will be clearly seen in FIG. 1. The side walls of the insert form gill openings 15 having mouths facing upwards on the outer side of the insert, the short sides having, furthermore, a number of vertical slots 16 The insert bottom wall is perforated. In the interior of the insert a number of grids 17 may be provided to support portioned packages 18 at several levels.

On the top of the counter a closure lid 19 is positioned over the well, fitting with a skirt 20 in the top opening of the well and carrying in a separate casing 21 on its upper side an electric drive motor 22 connected to a centrifugal fan 23 arranged on the lower side of the lid. This fan is surrounded by an electric heater formed by a tubular heating element 24 connected with terminals 25 for an electric connection cable below the casing 21. On the outer side of said casing knobs 26 and 27 for a timer and a thermostat, respectively, are provided for conveniently setting the time during which the fan is to operate with the heater connected so as to heat the circulating air, as well as the desired temperature of the heated air which is forced to circulate through the well. A control lamp 28 is also provided to indicate that the heater and the fan are energized.

When heated air is forced to circulate by means of the fan, said air will be sucked into the center of the well and will subsequently be blown out along the side walls and bottom of the well and the insert, respectively, in the air passages formed by the gap between these two elements as indicated by arrows in FIG. 1. The air will be diverted by the gills into the insert at different levels between the several grids and it will also pass up into the insert through the perforated bottom thereof. Thus by using the lid and insert there is provided a highly effective hot air oven for thawing deep-frozen portion packages but also for frying, since it is possible to produce an effective circulation of hot air through the oven to achieve the temperature required for frying, provided the heater is of a satisfactory capacity.

However, according to the invention it is furthermore suggested to provide the lower side of the lid with infra elements for grilling in the well when desired and elements for electronic warming so that the well can be used as an electronic oven when this is desired. Finally, the heater may be provided with a capillary tube for the supply of water, a motor-driven water pump being installed in the lid, so that the oven may be used also for thawing of deep-frozen packages by steam or for steam boiling. Thus, in one and the same apparatus being a supplement of a conventional well in a counter and having a lid with the necessary electric apparatus, as well as an insert of a very simple form, there is provided an oven allowing a considerable range of variety by simple means and consequently at a modest price, making it a useful supplementary apparatus in small restaurants particularly in canteens.

What I claim is:

1. An oven for treating of food comprising in combination a well of metal sheet material having a bottom and side walls and open at the top thereof, a removable insert of metal sheet material having vertical side wall means and a bottom and an open mouth at the top thereof in said well, said side wall means and said bottom of said insert being spaced from the side walls and the bottom of the well to define air circulating passages therebetween with the top of the circulating passages being open, said insert having gill openings formed in the portion of the vertical wall means of the insert defining the air passages and disposed substantially uniformly along and around the vertical limiting surfaces of said insert at different levels thereof and having the mouth thereof facing upwards on the outer side of the insert to divert air from said passages into the interior of the insert, said insert further having means for defining opening means at the bottom thereof for communicating the air passages with the interior of said insert, a lid removably fitted over the well to form a top closure thereof, an air circulating fan mounted on the lower side of the lid for drawing air upwardly out of the insert through the open mouth thereof, said fan propelling the air laterally to the open top of the air passages for circulation downwardly through the air passages for entry into the interior of the insert for circulation over the object to be heated, an electrical heater mounted on the lower side of the lid for heating air circulated by said fan, and said insert being provided with air previous support means for supporting the object to be heated.

2. An oven as claimed in claim 1 further comprising an electric drive motor for said air circulating fan supported by said lid, control means for said drive motor and said electrical heater, and terminal means for the electric connection of the drive motor and the heater.

* * * * *